United States Patent [19]

Ohashi

[11] Patent Number: 4,737,892

[45] Date of Patent: Apr. 12, 1988

[54] SWITCH ARRANGEMENTS IN PORTABLE FLASHLIGHTS

[75] Inventor: Keiichi Ohashi, Shizuoka, Japan

[73] Assignee: Skylite Industry Co., Ltd., Shizuoka, Japan

[21] Appl. No.: 885,690

[22] Filed: Jul. 15, 1986

[30] Foreign Application Priority Data

May 7, 1986 [JP] Japan ..... 61-104085

[51] Int. Cl.[4] ..... F21L 7/00

[52] U.S. Cl. ..... 362/206; 200/60

[58] Field of Search ..... 362/202, 205, 204, 206, 362/157, 208; 200/60, 153 LD; 243/155 A

[56] References Cited

U.S. PATENT DOCUMENTS 1,236,657 8/1917 Bauer ..... 362/206
1,855,015 4/1932 Fraser et al. ..... 362/206
2,225,936 12/1940 Williams ..... 200/153 LB
2,677,022 4/1954 Fleming ..... 362/206
4,278,853 7/1981 Wakabayashi et al. ..... 200/60

*Primary Examiner*—William A. Cuchlinski, Jr.
*Assistant Examiner*—D. M. Cox
*Attorney, Agent, or Firm*—Wegner & Bretschneider

[57] ABSTRACT

A portable flashlight including a body having therein a dry cell assembly and a dry cell holder frame and having on its front face a light source unit, wherein the body is provided on the bottom face with a first contact plate coming into contact with a first dry cell and a second contact plate coming into contact with a second dry cell, one of said contact plates being integrally provided with a projecting contact piece, which has its contact end extended above the other contact plate, and an axially turnable keep member is attached on the contact piece, said keep member being turned at a given angle, whereby the contact piece is forced down into contact with the other contact plate.

1 Claim, 2 Drawing Sheets

SWITCH ARRANGEMENTS IN PORTABLE FLASHLIGHTS

BACKGROUND OF THE INVENTION

1. Field of the Invention

The present invention relates to a switch arrangement in a portable flashlight, which is characterized in that a switch is mounted at the rear end of a body.

2. Statement of the Prior Art

As disclosed in Japanese Utility Model Publication No. 52-17992, for instance, one known type of a portable flashlight includes a dry cell holder detachably inserted and housed within a casing, a set of dry cells held within the holder, an electrical bulb attached to the front end of the holder and a switch attached to the rear end of the holder.

In the aforesaid type of portable flashlight, however, since connection is electrically and mechanically made between the dry cells and the bulb with the use of outer and inner coil springs, the structure of such connection becomes complicated. To add to this, even when replacing either one of the dry cells and the bulb, it is always required to remove both parts at the same time, so that breakage of the bulb may take place at the time of their removal. Since the switch is of the structure that the switch piece is slidably moved to open or close the contacts, so that difficulty is involved in making the switch waterproof. Thus, with the prior art flashlight, it is difficult to achieve a sufficient waterproof structure.

With a view to solving such problems, the present inventor has proposed to provide a portable flashlight in which the operating member for a switch is made axially turnable, and has already filed a patent application therefor (Japanese Patent Application No. 60-271141).

While the flashlight proposed in the aforesaid patent application is much superior in the waterproofness achieved to the prior art one as mentioned in the foregoing, it is noted that the switch portion is complciated in structure, and the number of parts is increased for reasons of using the dry cell holder as one consitutional element of the switch, so that a good deal of time is required for assembling.

SUMMARY OF THE INVENTION

With the foregoing problems in mind, a primay object of the present invention is to provide a portable flashlight which is simplified in the structure, involves a reduced number of parts, is easy to assemble, and shows a high degree of waterproofness.

According to the present invention, this object is achieved by the provision of a portable flashlight including a body having therein a dry cell assembly and a dry cell holder frame and on its front face a light source unit, characterized in that the body is provided on the bottom face with a first contact plate coming into contact with a first dry cell and a second contact plates being integrally provided with a contact piece, which has its contact end extended above the other contact plate, and an axially turnable keep member is attached on the contact piece, said keep member being turned at a given angle, whereby the contact piece is forced down into contact with the other contact plate.

BRIEF DESCRIPTION OF THE DRAWINGS

The aforesaid and other objects and features of the present invention will become apparent from a reading of the following detailed description with reference to the accompanying drawings, which are given for the purpose of illustration alone, and in which.

DETAILED DESCRIPTION OF THE PREFERRED EMBODIMENTS

Figure 4:
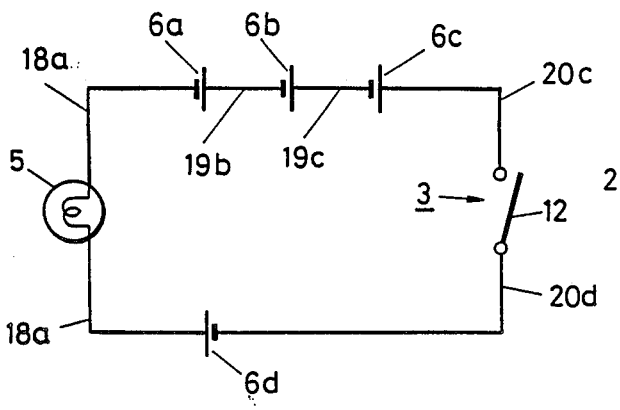
FIG. 4 is a circuit diagram.
Figure 1:
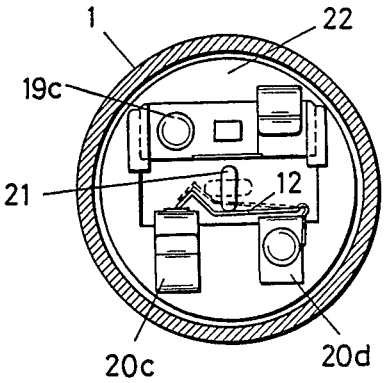
FIG. 1 is a longitudinally sectioned veiw showing one embodiment of the present invention.
Figure 3:
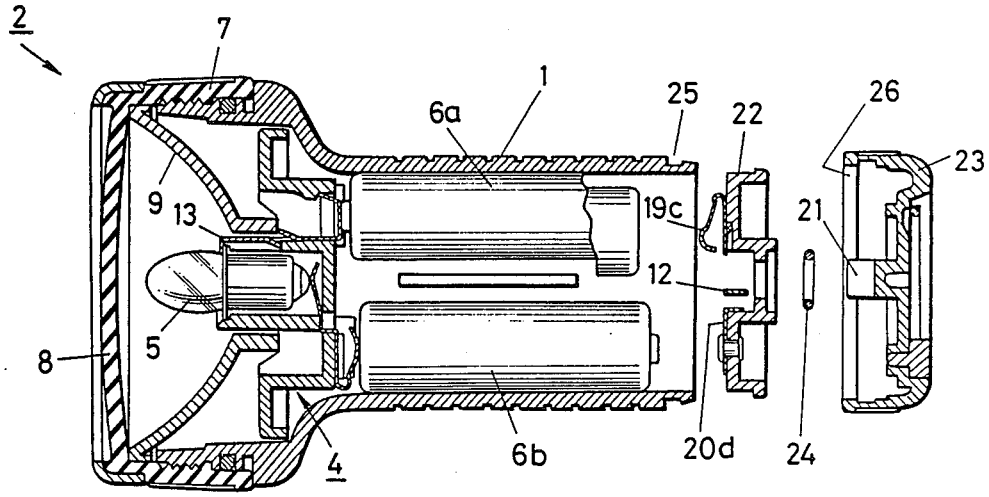
FIG. 3 is a longitudinally sectioned view.
Figure 2:
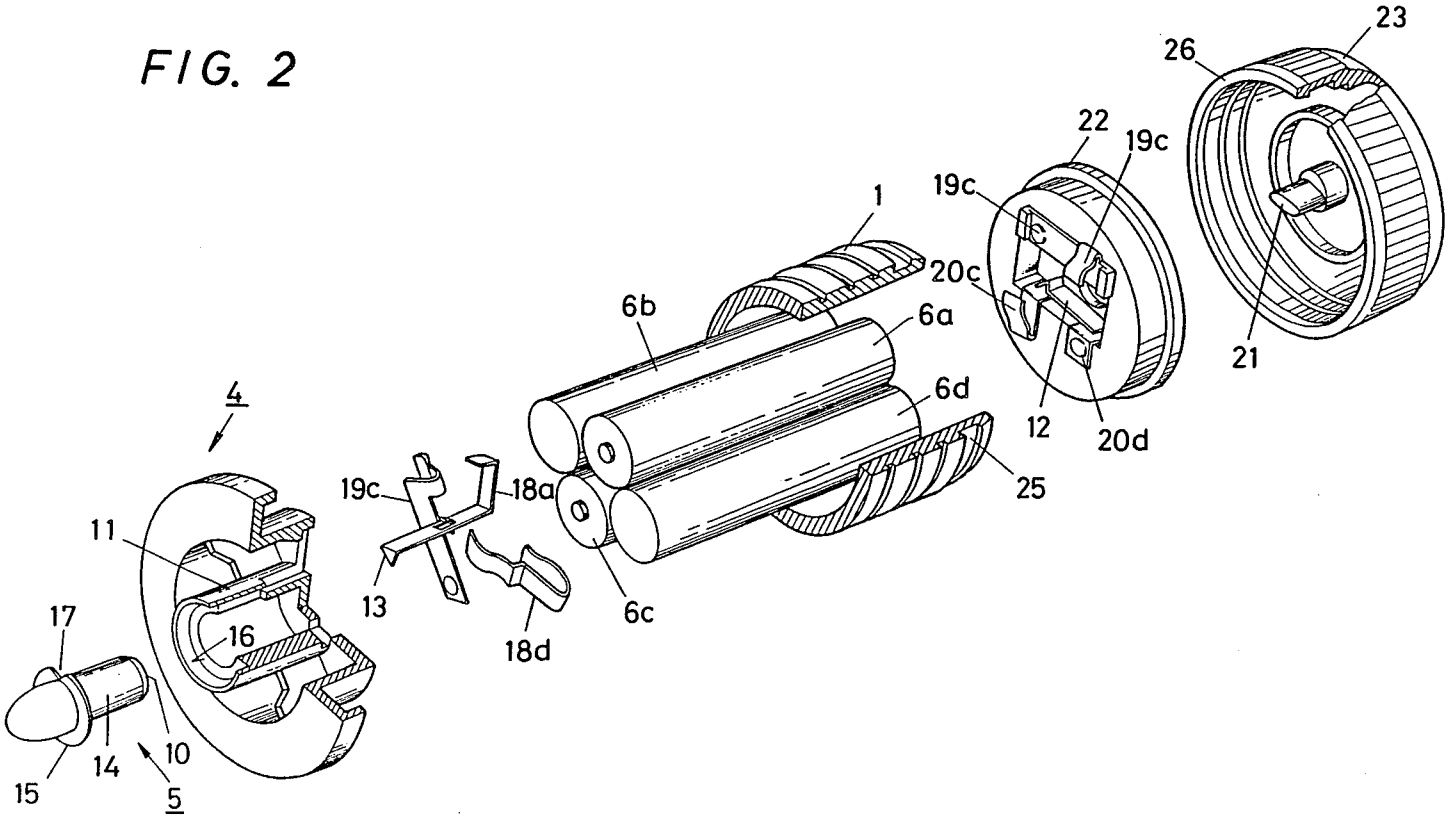
FIG. 2 is an exploded perspective view showing parts of that embodiment.

Referring to the drawings, the present invention is shown to be applied to a small-sized portable flashlight in which four dry cells are used. Reference numerals 1, 2, 3 and 4 stand for a body, a light source unit, a switch and a dry cell holder frame, respectively. The basic arrangement is similar to that of the prior art arrangement, except that an electric bulb 5 is adapted to be attached to the holder 4, not to the light source unit 2. More specifically, the body 1 defines a main part of the portable flashlight, and includes therein a dry cell assembly 6 and the holder frame 4 for fixing the assembly 6 in place within the body 1 and defining a part of a conduction circuit for connecting the assembly 6 to the bulb 5. The body 1 is open at the front face for attachment of the light source unit 2, and has at the rear end the switch 3 for putting on or off the bulb 5.

In the illustrated embodiment, the electric bulb 5 is designed to be attached to the holder frame 4. The light source unit 2 comprises a frame 7 for mounting it to the body 1, a lens 8 and a parabolic reflector 9. The cell holder frame 4 is provided therethrough with a mount cylidrical member 11 at a position corresponding to an insertion hole for the reflector 9, and is formed on its end with a locking hook 13, whereby the bulb 5 is attached to the cell holder frame 4, more specifically, to the mount cylinder 11.

That is, a flange 15 of the bulb 5 is cut out in one or more positions to define a cutout 17. On the other hand, as illustrated, the mount cylinder 11 has its inner diameter slightly larger than the diameter of a base 14 of the bulb 5 and slightly smaller than the inner diameter of the flange 15, so that only the base portion 14 of the bulb 5 is fitted into the cylinder 11 to lock the flange 15 on the front end face thereof. At the same time, the locking hook 13 sligtly smaller in size than the cutout 17 is located at a position slightly projecting from the front end face 16. While the cutout 17 is in coincidence with the locking hook 13, the base 14 is fitted into the mount cylinder 11 until the flange 15 reaches the front end face 16. Then, by turning the flange 15 in either one of the opposite directions, the cutout 17 is shifted relative to the locking hook 13 to interpose the flange 15 between the front end face 16 and the locking hook 13, whereby the bulb 5 is attached to the mount cylinder 11.

As can be seen from FIG. 4, in the embodiment of the present invention, four dry cells *6a–6d* are connected in series with the bulb 5 being positioned between *6a* and *6d*, and the switch 3 being positioned between *6c* and *6d*. Correspondingly, the cell holder frame 4 is provided with an earth *18a* for making conduction between the flange 15 of the bulb 5 and the cell *6a*, a ground *18d* for making conduction between a central contact 10 of the bulb 5 and the dry cell *6d*, and a lead *19b* for making conduction between the dry cells *6b* and *6c*. On the bottom of the body 1, there is a lead *19a* for making conduction betweend the dry cells 6*a* and 6*b* and the switch 3 for making connection between 6*c* and 6*d*.

Referring further to the switch 3, it comprises a contact plate 20*c* contiguous to the dry cell 6*c*, a contact plate 20*d* contiguous to the dry cell 6*d* and a keep member 21. A contact piece 12 projects integrally from the contact plate 20*d*, and has its contact end located above the contact plate 20*c*. The keep member 21 is mounted on the contact piece 12 in an axially turning manner, so that it is turned at a given angle (90° in the instant embodiment) to force down the contact piece 12 and thereby bring it into contact with the contact plate 20*c*. Further turning of the keep member 21 at a given angle causes it to disengage the contact plate 20*c*.

In the illustrated embodiment, the contact plate 20 is attached to a mount plate 22 provided separately from the body 1, and the keep member 21 is made integral with a cap 23. The resulting integral member is attached to the rear end of the body 1 to define the bottom thereof. In particular, the cap 23 is attached to the rear end of the body 1 by fitting a rim 26 formed on the cap 23 into a groove 25 formed on the outer face of the rear end of the body 1. While a mount plate 22 is positioned between the body 1 and the cap 23, an O-ring 24 is then interposed between the mounted plate 22 and the cap 23. The reason for providing the mount plate 22 separately from the body 1 is to facilitate mounting of the mount plate 22. Accordingly, where mounting of the mount plate 20 is carried out without difficulty, even when the body 1 is increased in size and its bottom face is made integral with the body 1, the mount plate 22 may be dispensed with.

According to the present invention, the body 1 is provided on the bottom face with the first contact plate coming into contact with the first dry cell and the second contact plate coming into contact with the second dry cell. One of both contact plates is provided with the projecting contact piece, which is in turn forced down by the axially turnable keep member for making conduction between both contact plates, thereby putting on the electrical bulb. Thus, the number of the parts forming the portable flashlight according to the present invention is so decreased that the structure thereof is very simplified. Consequently, the portable flashlight of the present invention can be used without any malfunction.

I claim:

1. A portable flashlight, comprising a body containing at least two dry cells, a light source unit attached to a first end of the body, and first and second contact plates disposed in a second end of the body, said first contact plate being in contact with a first dry cell, said second contact plate being in contact with a second dry cell and having a projecting contact piece which extends above the first contact plate, said portable flashlight further comprising an end cap rotatably fitted to said second end, said cap having a keeper integrally attached thereto and projecting from, wherein when said cap is rotated, the keeper presses the projecting contact piece against the first contact plate.

* * * * *